US005316153A

United States Patent [19]

Crawford et al.

[11] Patent Number: 5,316,153

[45] Date of Patent: May 31, 1994

[54] DISPLAY CASE APPARATUS

[75] Inventors: Dennis L. Crawford, Dallas; Barry K. Rutherford; Paul E. Chandler, both of Plano, all of Tex.

[73] Assignee: Chippenhook Corporation, Lewisville, Tex.

[21] Appl. No.: 911,875

[22] Filed: Jul. 10, 1992

[51] Int. Cl.[5] ..... B65D 1/34

[52] U.S. Cl. ..... 211/13; 206/566

[58] Field of Search ..... 211/13, 70.1, 72, 85, 211/133, 195; 40/152, 155; 248/473, 151, 165; 206/566, 495

[56] References Cited

U.S. PATENT DOCUMENTS

| | | | |
|---|---|---|---|
| 781,518 | 1/1905 | Hice | 211/72 |
| 3,514,886 | 6/1970 | Drackard | 40/155 |
| 3,858,726 | 1/1975 | Rosenwein | 211/13 |
| 4,095,361 | 6/1978 | Ledenican | 40/152 |
| 4,244,303 | 1/1981 | Kurasik | 40/152 |
| 4,687,103 | 8/1987 | Corbett | 248/473 |
| 4,787,516 | 11/1988 | Morrison | 206/566 |
| 4,862,612 | 9/1989 | Sugihara et al. | 40/152 |
| 4,913,289 | 4/1990 | Feiler | 206/566 |

FOREIGN PATENT DOCUMENTS

| | | | |
|---|---|---|---|
| 2623384 | 5/1989 | France | 211/13 |

OTHER PUBLICATIONS

The Maurner Company Custom Display Catalog p. 34.
Chippenhook, Ltd. Custom Display Catalog pp. 33–34.
Bufkor Custom Display Catalog p. S69.

*Primary Examiner*—Paula A. Bradley
*Assistant Examiner*—Erik R. Puknys
*Attorney, Agent, or Firm*—Johnson & Gibbs

[57] ABSTRACT

A display case for displaying jewelry items or the like has a rectangular base unit with a base wall peripherally bordered by an upstanding frame section. A rear end wall of the frame structure is removable to permit insertion through the resulting frame opening of a display insert structure configured to support jewelry items such as rings and bracelets. As the display structure in inserted inwardly through the frame opening, opposite side edge portions of the display structure are slidably received in inner side surface grooves in the opposite frame side walls. When the display structure is fully inserted into the frame interior, the rear frame wall is reattached to thereby give the inserted display structure the appearance of being permanently framed within a dedicated display case. However, due to the base unit configuration, the display structure may be easily removed and replaced with a second, differently configured display insert structure to give the second insert structure the same permanently framed appearance using the same base unit.

19 Claims, 2 Drawing Sheets

DISPLAY CASE APPARATUS

BACKGROUND OF THE INVENTION

1. FIELD OF THE INVENTION

The present invention generally relates to displaying apparatus and, in a preferred embodiment thereof, more particularly relates to display case structures for displaying jewelry items such as rings and bracelets and non-jewelry items such as eyewear, scarves, coins, small leather goods and pens.

2. HISTORY OF THE PRIOR ART

Jewelry items to be sold, such as rings and bracelets, are conventionally supported in an attractive arrangement on the top side of a display case structure that typically comprises a framed, pad-like base on which appropriate slots, curved support structures and the like are formed to hold the jewelry items in the predetermined display arrangement thereof, and readily permit one or more of the items to be removed by a salesperson and handed to a potential customer for a closer inspection of the item. Non-jewelry items such as eyewear, coins, small leather goods and pens may be similarly displayed.

Display cases of this general type have been conventionally constructed for a number of years as fixed configuration, "dedicated" units, each shaped to support and display only a given type or types of sale items in a predetermined nonvariable arrangement. For example, a first conventional framed display case of this sort might be permanently configured to support and display only rings, with a second separate framed display case permanently configured to support and display only bracelets, and a third separate framed display case permanently configured to support and display only rings and bracelets in a fixed relative positioning of these two jewelry items.

This conventional construction of framed display oases, for both jewelry and non-jewelry items, significantly limits the display flexibility of each case and thus often requires that a seller purchase and store a substantial number of these fixed configuration framed display oases to provide him with the ability to selectively alter both the types of items displayed and their relative orientation in a given display setting. Additionally, changing the merchandise mix and the ability to vary inventory levels in the current economic environment, makes permanent, single purpose fixtures impractical.

It can readily be seen from the foregoing that it would be desirable, from cost, storage space and display flexibility standpoints, to provide a single framed display case structure which could readily accommodate a variety of displayed item types in a selectively changeable array thereof. It is accordingly an object of the present invention to provide such a framed display case structure.

SUMMARY OF THE INVENTION

In carrying out principles of the present invention, in accordance with a preferred embodiment thereof, an improved framed display case is provided that may be rapidly and easily altered to support and display a variety of item types, representatively jewelry items such as rings and bracelets and non-jewelry items such as sunglasses, in changeable relative arrays thereof.

The display case comprises a rectangular base wall having secured around its periphery an upstanding rectangular support frame structure defining with the base wall an open-topped cavity portion of the case. An end wall of the frame structure, preferably the rear end wall thereof, is removable from the balance thereof to reveal a cavity end opening inwardly through which a display insert structure may be passed into the frame interior. The rear wall may, in a preferred embodiment, be affixed to the display insert. The top side of the insert structure is appropriately configured to support and display one or more types of jewelry or other items. For example, the base unit may be provided with a slotted, primary insert into which the seller may plug a range of small display fixtures for rings, earrings, bracelets and the like. A non-jewelry aspect of the invention is the seller's ability to have a primary unit showing men's wallets and card cases with the flexibility to replace that insert with one for women's wallets.

The display insert structure is configured when so inserted to essentially fill the frame interior, and is retained therein by inner side grooves formed on the opposite frame side walls that slidingly receive opposite parallel edge portions of the insert structure. After the insert structure is operatively positioned within the frame cavity, the previously removed frame end wall is reattached to the balance of the base unit. This reattachment of the frame end wall gives the insert structure the desirable appearance of being permanently framed within a dedicated display case.

However, the insert structure may be easily and quickly removed from the base unit, simply by again removing the aforementioned frame end wall (which may or may not be secured to the insert), and replaced with a second display insert structure having a differently configured top side portion adapted to support and display different jewelry or other items in a different array thereof. Reattachment of the removed frame end wall gives the second insert structure the similar appearance of being permanently framed within a dedicated display case using the single base unit.

By using a variety of display insert structures, having differently configured top side item support portions, with this single, specially configured base unit a great variety of items may be displayed, in changeable orientations thereof, without the previous necessity of purchasing a large number of fixed configuration, dedicated framed display cases to achieve displayed item type and array variety. This attribute of the present invention can significantly reduce merchandiser display costs, as well as diminishing the storage space requirements for the display apparatus when not in use, while at the same time providing a great deal of display flexibility.

According to a feature of the present invention, the display flexibility of the apparatus is further enhanced by providing a display insert structure with a flat rectangular body portion through which a spaced plurality of lateral openings are formed. In conjunction with this flat body portion a plurality of support pad members are provided, each configured to support a certain type of item to be displayed, and also configured to be removably and complementarily received in one of the body openings. The pads and body openings are preferably configured in a manner such that any of the pads can be complementarily received in any of the openings. By simply rearranging the pads on the body portion, a number of different relative displayed item arrays may be conveniently fashioned on the same display insert structure.

In accordance with another aspect of the invention, the side walls of the frame structure are plastic extrusions provided with upstanding wall portions having inner side tracks thereon that receive and retain opposite edge portions of the base wall, and the removable front and rear frame end walls are plastic moldings having transverse clip means projecting inwardly from their opposite ends and operative to frictionally engage ends of the upstanding wall portions of the frame side wall extrusions and releasably attach the frame end walls to the balance of the support frame structure.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Figure 1:
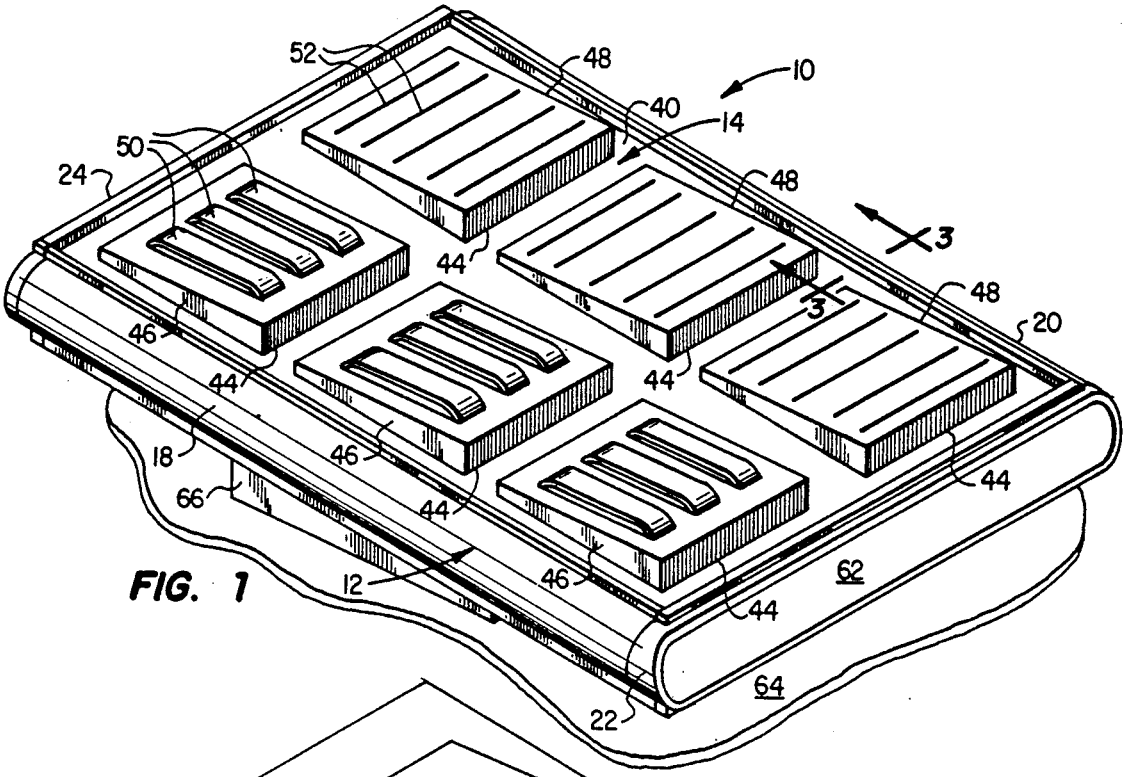
FIG. 1 is a perspective view of a framed display case embodying principles of the present invention and including a specially designed base unit and a representative first display insert structure removably supported in the base unit.
Figure 4:
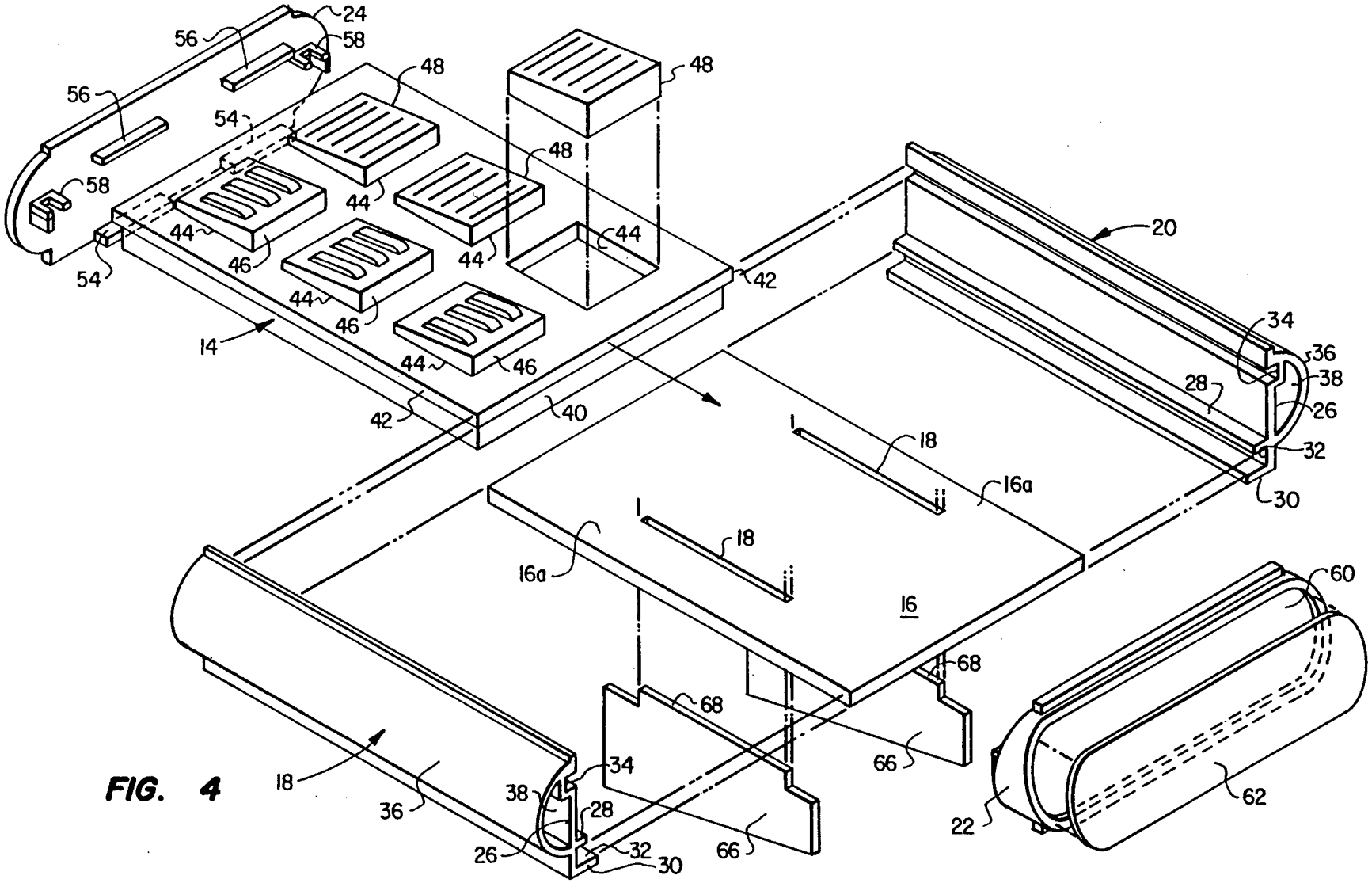
FIG. 4 is a reduced scale exploded perspective view of the framed display case shown in FIG. 1.

Referring first to FIGS. 1 and 4 in combination, there is shown an improved framed display case 10 that embodies the principles of the present invention and is representatively adapted to support and display jewelry items such as rings and bracelets and non-jewelry items such as eyewear. Display case 10 includes a specially designed base unit 12 which, in a manner subsequently described, removably receives and supports a representative display insert structure 14.

The base unit 12 includes a rectangular base wall 16 having a pair of opposite parallel side edge portions 16*a* and a pair of spaced apart, parallel slots 18 formed therethrough. An upstanding rectangular support frame structure is carried on and extends around the periphery of base wall 16, the support frame structure including left and right extruded plastic frame side wall members 18 and 20; an injection molded plastic front frame end wall member 22; and an injection molded plastic rear frame end wall member 24.

Figure 3:
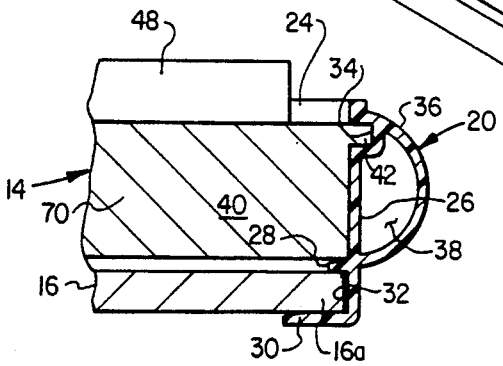
FIG. 3 is an enlarged partial cross-sectional view through the framed display case taken along line 3—3 of FIG. 1.

As best illustrated in FIGS. 3 and 4, each of the extruded frame side wall members 18, 20 has, in cross-section along its length, a vertical side wall 26 with vertically spaced inturned lips 28 and 30 disposed at its lower end and defining therebetween a groove or track 32 extending along the length of the extrusion along its inner side. An indentation adjacent the upper end of extrusion wall 26 forms along its inner side a groove or track 34. A decorative, convexly curved wall portion 36 extends outwardly along the extrusion wall 26 and forms therewith a cavity 38 within the extrusion. The side edge portions 16*a* of the base wall 16 are received in the lower extrusion grooves 32, and are permanently secured therein by means of a suitable adhesive material.

The display insert structure 14 has a rectangular body panel portion 40 with a pair of outwardly projecting side edge flange portions 42 adjacent its top side. Six spaced apart rectangular openings 44 are formed through the top side of body portion 40 - three of the openings removably and complementarily receiving rectangular display pads 46, and three of the openings removably and complementarily receiving rectangular display pads 48. Pads 46 have arcuate members 50 projecting upwardly from their top sides and configured to support and display watches or bracelets, and pads 48 have top side slots 52 therein for supporting and displaying rings.

Preferably, the openings 44 and the pad body cross-sections are identically sized so that any pad can be complementarily inserted within any of the openings. Accordingly, when the display insert structure 14 is removably received within the support frame structure as later described, the relative positions of the pads 46, 48 can be conveniently switched around at will to vary the overall ring/bracelet display array.

In one embodiment of the display case 10, both the front and rear frame end wall members 22 and 24 may be removable from the balance of the base unit 12. In the preferred embodiment, the rear frame end wall member 24 (FIG. 4) is affixed to the insert 14 by conventional adhesive or fasteners. End wall member 24 has a pair of inwardly projecting transverse tabs 54 adjacent its lower side edge; a similar pair of tabs 56 positioned above tabs 54; and a pair of resilient clips 58 projecting inwardly from the opposite ends of the rear frame end wall member 24. To secure the rear frame end wall member 24 and insert 14 to the balance of the base unit 12, the clips are simply snapped onto the rear ends of the side wall extrusion wall portions 26.

In the preferred embodiment, the inner or rear side of the front frame end wall member 22 is affixed to the base wall 16. End wall member 22 is also provided with end clips 58 (not visible). Accordingly, the front frame end wall member 22 and base wall 16 may also be removably attached to the balance of the base unit 12 by simply snapping its clip members onto the front ends Of the side wall extrusion wall portions 26. In this manner, the end users will find it easier to maintain, and not lose, the end wall members 22 and 24. As best illustrated in FIG. 4, the front side of frame wall member 22 is recessed as at 60. Recess 60 removably receives a snap-in face plate 62 upon which suitable indicia may be imprinted to indicate the type or types of jewelry or other items being displayed in case 10.

As can be seen in FIG. 1, the base unit 12 is resting on a horizontal support surface 64, and is rearwardly and upwardly sloped relative to such surface. This attractive display slope is achieved by means of a pair of angled support plates 66 (FIG. 4) having upper side edge tabs 68 upwardly inserted into the base wall slots 18.

With the front frame end wall 22 attached to the base wall 16, the display insert structure 14 is operatively and removably installed within the frame structure cavity 70 (see FIG. 3) by forwardly passing the insert structure body 40 and the wall 24 attached thereto into the rear frame end opening. As the insert structure body 40 enters the frame cavity 70, the front ends of its side edge flanges 42 enter the upper extrusion grooves 34. The balance of the insert structure body 40 is then pushed into the frame cavity, as the flanges 42 slide along the interiors of grooves 34, until the front end of the body 40 reaches the front frame end wall 22 at which point the body 40 essentially fills the frame cavity 70. The rear frame end wall 24 preferably snaps into place on the rear ends of the frame side wall extrusions 18 and 20 at this point.

Referring back to FIG. 1, in the assembled display case 10 the operatively supported display insert structure 14 is given the desirable appearance of being permanently framed within a dedicated display case. However, and quite importantly, the display insert structure 14 and wall 24 may be quickly and easily removed from the base unit 12 and replaced with another display insert structure having a similarly configured body portion but a differently configured top side display portion. The second display insert structure will similarly be given the appearance of being permanently framed in a dedicated display case using the same base unit 12.

Figure 2:
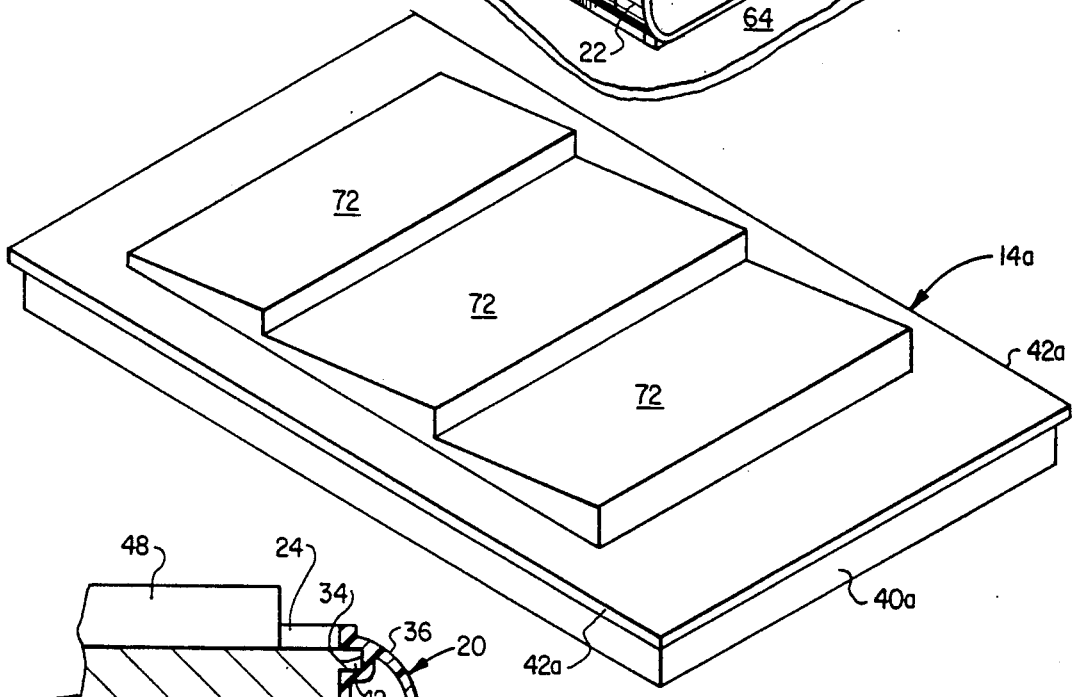
FIG. 2 is a perspective view of a representative second display insert structure that may be interchanged with the first display insert structure in the base unit.

As an example of the display insert structure interchange-ability provided by the uniquely configured base unit 12 of the present invention, a representative additional display insert structure 14*a* is depicted in FIG. 2. Insert structure 14*a* has a rectangular body portion 40*a* with a length and end-to-end cross section identical to those of the body portion 40 of insert structure 14, including side edge flanges 42*a*. However, the second display insert structure 14*a* has a differently configured top side display section—representatively in the form of an upwardly projecting, stair-stepped series of display pedestals 72. The end wall 24 is not shown secured thereto. This is an optional attachment feature although its securement to the inserts 14, 14*a* is recommended to reduce the number of parts which must be assembled.

All that is necessary to replace insert structure 14 with insert structure 14*a* (or a selected one of a variety of different insert structures kept on hand) is to slide out the insert structure 14 and rear frame end wall 24 from the base unit 12, and slide the new insert structure into the base unit as previously described.

It will be readily appreciated that the top display side configurations of the display insert structures 14, 14*a* are merely representative of a multiplicity of possible display configurations. The two or more display insert structures interchangeable within the base unit can, of course, be configured to support and display items other than jewelry items such as sunglasses, and one or more of the insert structures can simply be a flat panel with suitable indicia imprinted on its upper side.

By utilizing the single base unit 12 in conjunction with several interchangeable, but differently configured display insert structures, each insert structure may be given a desirable framed-in display case appearance without the previous necessity of purchasing a similar number of permanently framed display structures. This provides the opportunity for significantly reducing overall display costs, and associated display apparatus storage space requirements, while at the same time providing for significantly enhanced display arrangement flexibility and variety.

The foregoing detailed description is to be clearly understood as being given by way of illustration and example only, the spirit and scope of the present invention being limited solely by the appended claims.

What is claimed is:

1. A display case base unit for interchangeably receiving, supporting and displaying a selectively variable one of a plurality of display inserts each having an opposed pair of similarly sized and spaced apart parallel side edge portions, said base unit comprising:

a rectangular base wall having first and second pairs of opposed side edges;

an upstanding rectangular support frame structure secured to and extending around the periphery of said base wall, said support frame structure defining with said base wall an open-topped cavity portion of said base unit permitting substantially unobstructed viewing of the selected display insert operatively received in said base unit, said support frame structure being sized to peripherally circumscribe each of the display inserts and including:

first and second frame side members secured to and longitudinally extending along said first pair of opposed side edges of said base wall, said first and second frame side members having inner side surface portions disposed above said base wall, a third frame side member extending along one of said second pair of opposed side edges of said base wall between first ends of said first and second opposed side edges of said base wall, a fourth frame side member, attachment means for removably attaching said fourth frame side member to said first and second frame side members to extend along the other of said second pair of opposed side edges of said base wall between the second ends of said first and second frame side members, and groove means, formed in and extending along the lengths of said inner side surface portions of said first and second frame side members, for slidably receiving the opposite side edge portions of a selected one of the display inserts as the insert is moved into said cavity portion of said base unit, toward said third frame side member, with said fourth frame side member temporarily removed from said first and second frame side members, and elevating means associated with the underside of said base all and engageable with a horizontal support surface upon which said base unit is rested, said elevating means being operative to slope the base unit at a predetermined angle relative to the support surface, whereby, after reattaching said fourth frame side member to said first and second frame side members, the selected display insert is given the appearance of being permanently framed within a dedicated display case, but may be readily removed and replaced with a selected second one of the display inserts to give the second display insert the same permanently framed appearance using the same base unit.

2. The display case base unit of claim wherein:

said fourth frame side member is removable from said display insert, said base unit further comprises attachment means for removably securing said third frame side member to the balance of said base unit, and said third frame side member has an outer side surface recess formed therein and configured to complementarily and removably receive a face plate member having indicia thereon indicative of the type of items being displayed on the display insert operatively supported by said base unit.

3. The display case base unit of claim 1 wherein:

said fourth frame side member is affixed to said display insert for removal therewith from said first and second frame side members, said first and second frame side members having support grooves formed along the inner sides thereof below and parallel to said groove means, and said first pair of opposed side edges of said base wall being received and mounted within said support grooves.

4. The display case base unit of claim 1 wherein:

said fourth frame side member extends along a rear side of said base unit, and said elevating means are operative to rearwardly and upwardly slope said base unit relative to the support surface.

5. The display case base unit of claim 1 wherein:

said base wall has a plurality of slots formed therethrough, and said elevating means comprise a plurality of angled support plate members having upper side edge portions upwardly and removably insertable into said slots.

6. The display case base unit of claim 1 wherein:

said first and second frame side members are plastic extrusions having side wall portions, and said fourth frame side member is a plastic molding having clip means transversely projecting inwardly from its opposite ends and operative to frictionally and releasably engage ends of said side wall portions of said first and second frame side members.

7. The display case base unit of claim 6 wherein:

said third frame side member is a plastic molding and is removable from the balance of said base unit said third frame side member having clip means transversely projecting inwardly from its opposite ends and operative to frictionally and releasably engage ends of said side wall portions of said first and second frame side members.

8. Improved display case apparatus comprising:

a base unit including a rectangular base wall having first and second pairs of opposed side edges, and an upstanding rectangular support frame structure secured to and extending around the periphery of said base wall, said support frame structure defining with said base wall an open-topped cavity portion of said base unit, said support frame structure including:

first and second frame side members secured to and longitudinally extending along said first pair of opposed side edges of said base wall, said first and second frame side members having inner side surface portions disposed above said base wall, a third frame side member extending along one of said second pair of opposed side edges of said base wall between first ends of said first and second opposed side edges of said base wall, a fourth frame side wall, attachment means for removably attaching said fourth frame side wall to said first and second frame side members, and elongated first grooves formed in and longitudinally extending along the lengths of said inner side surface portions of said first and second frame side members; and at least one display insert structure having an opposed pair of similarly sized and spaced apart parallel side edge portions, each of said at least one display insert structure being configured in a manner such that, with said fourth frame side member temporarily removed from the balance of said base unit, ends of the display insert structure side edge portions may be inserted into the ends of said first grooves previously adjacent the removed fourth frame side member and then slide within said first grooves into said cavity, toward said third frame side member, to removably insert and support the display insert structure within said cavity, the inserted display insert structure being configured to substantially fill said cavity, and elevating means associated with the underside of said base all and engageable with a horizontal support surface upon which said base unit is rested, said elevating means being operative to slope the base unit at a predetermined angle relative to the support surface, whereby, by reattaching the fourth frame side member to said frame side members the inserted display insert structure is given the appearance of being permanently framed within a dedicated display case, but may be readily removed and replaced with a second, similarly sized display insert structure to give the second display insert structure the same permanently framed appearance using the same base unit.

9. The improved display case apparatus of claim 8 wherein:

said fourth frame side member is removable from said at least one display insert, and said at least one display insert structure comprises a plurality of display insert structures having differently configured upper side portions.

10. The improved display case apparatus of claim 8 wherein:

said fourth frame side member is affixed to said at least one display insert, and said at least one display insert structure includes a display insert structure having an upper side portion configured to support and display jewelry items.

11. The improved display apparatus of claim 8 wherein said at least one display insert structure includes a display insert structure having:

a rectangular body portion upon which said display insert structure side edge portions are disposed, a spaced plurality of openings extending laterally through said body portion, and a plurality of display pads configured to be removably and complementarily received in said openings, and to removably support items to be displayed.

12. The improved display apparatus of claim 11 wherein:

said display pads are configured to support jewelry items

13. The improved display apparatus of claim 11 wherein:

said openings and display pads are configured to permit any of said display pads to be complimentarily received in any of said plurality of openings.

14. The improved display apparatus of claim 8 wherein:

said base unit further comprises attachment means for removably securing said third frame side member to the balance of said base unit, and said third frame side member has an outer side surface recess formed therein and configured to complementarily and removably receive a face plate member having indicia thereon indicative of the type of items being displayed on the display insert operatively supported by said base unit.

15. The improved display apparatus of claim 8 wherein:

said first and second frame side members have support grooves formed along the inner sides thereof below and parallel to said first grooves, and said first pair of opposed side edges of said base wall are received and fixedly secured within said support grooves.

16. The improved display apparatus of claim 8 wherein:

said fourth frame side member extends along a rear side of said base unit, and said elevating means are operative to rearwardly and upwardly slope said base unit relative to the support surface.

17. The improved display apparatus of claim 8 wherein:

said base wall has a plurality of slots formed therethrough, and said elevating means comprise a plurality of angled support plate members having upper side edge portions upwardly and removably insertable into said slots.

18. The improved display apparatus of claim 8 wherein:

said first and second frame side members are plastic extrusions having side wall portions, and said fourth frame side member is a plastic molding having slip means transversely projecting inwardly from its opposite ends and operative to frictionally and releasably engage ends of said side wall portions of said first and second frame side members.

19. The improved display apparatus of claim 18 wherein:

said third frame side member is a plastic molding and is removable from the balance of said base unit, said third frame side member having slip means transversely projecting inwardly from its opposite ends and operative to frictionally and releasably engage ends of said side wall portions of said first and second frame side members.

* * * * *

UNITED STATES PATENT AND TRADEMARK OFFICE

CERTIFICATE OF CORRECTION

PATENT NO. : 5,316,153

DATED : May 31, 1994

INVENTOR(S) : Dennis L. Crawford, Barry K. Rutherford, Paul E. Chandler

It is certified that error appears in the above-indentified patent and that said Letters Patent is hereby corrected as shown below:

Column 1, line 39: Delete "oases"; insert --cases--

Column 1, line 43: Delete "oases"; insert --cases--

Column 4, line 42: Delete "Of"; insert --of--

Column 6, line 42: Delete "all"; insert --wall--

Column 6, line 56: After "claim", insert --1--

Column 8, line 8: Delete "slide"; insert --slid--

Column 8, line 15: Delete "all"; insert --wall--

Signed and Sealed this

Sixth Day of September, 1994

*Attest:*

*Attesting Officer*

BRUCE LEHMAN

*Commissioner of Patents and Trademarks*